US006591746B2

(12) United States Patent
Siler

(10) Patent No.: US 6,591,746 B2
(45) Date of Patent: Jul. 15, 2003

(54) REGISTRATION SYSTEM FOR PRINTING PRESS

(75) Inventor: Steven J. Siler, Lake Geneva, WI (US)

(73) Assignee: Hurletron, Incorporated, Libertyville, IL (US)

( * ) Notice: Subject to any disclaimer, the term of this patent is extended or adjusted under 35 U.S.C. 154(b) by 0 days.

(21) Appl. No.: 09/880,422

(22) Filed: Jun. 13, 2001

(65) Prior Publication Data

US 2003/0010235 A1 Jan. 16, 2003

(51) Int. Cl.[7] ..... B41F 13/00

(52) U.S. Cl. ..... 101/171; 101/181
(58) Field of Search ..... 101/171, 181

(56) References Cited

U.S. PATENT DOCUMENTS

| | | | | |
|---|---|---|---|---|
| 1,151,461 A | | 8/1915 | Hatt | |
| 3,073,997 A | | 1/1963 | Tagliasacchi | 318/85 |
| 3,468,201 A | | 9/1969 | Adamson et al. | 83/74 |
| 3,561,654 A | | 2/1971 | Greiner | 226/25 |
| 3,601,587 A | | 8/1971 | Thiede | 235/92 CC |
| 3,915,090 A | | 10/1975 | Horst et al. | 101/426 |
| 3,963,902 A | | 6/1976 | Dowd | 235/92 MP |
| 3,974,766 A | | 8/1976 | Zimmer | 101/129 |
| 3,998,156 A | | 12/1976 | Zimmer | 101/115 |
| 4,033,259 A | | 7/1977 | Schuhmann | 101/174 |
| 4,135,664 A | | 1/1979 | Resh | |
| 4,164,184 A | | 8/1979 | Vertegaal | 101/127.1 |
| 4,165,465 A | | 8/1979 | Kanatani et al. | 250/559 |
| 4,243,925 A | | 1/1981 | Gnuechtel | 318/603 |
| 4,349,880 A | | 9/1982 | Southgate et al. | 364/507 |
| 4,363,270 A | * | 12/1982 | Ury et al. | 101/180 |
| 4,366,542 A | | 12/1982 | Anselrode | 364/469 |
| 4,366,753 A | | 1/1983 | Glanz et al. | 101/181 |

(List continued on next page.)

FOREIGN PATENT DOCUMENTS

| | | |
|---|---|---|
| DE | 27 02 274 | 7/1978 |
| DE | 33 32 750 | 4/1985 |
| EP | 0 311 729 | 4/1989 |
| EP | 0 488 608 A1 | 11/1991 |
| EP | 0 835 753 A1 | 4/1998 |
| GB | 2 024 457 | 1/1980 |
| GB | 2 072 097 | 2/1980 |
| JP | 56-28864 | 3/1981 |
| NL | 7808954 | 3/1980 |
| RU | 499198 | 3/1976 |
| WO | WO 80/00231 | 7/1979 |

OTHER PUBLICATIONS

Hurletron Incorporated Drawing No. 309704, 1 sheet, dated Apr. 22, 1993.
Hurletron Incorporated Drawing No. 405876, 1 sheet, dated Nov. 26, 1990.

*Primary Examiner*—Charles H. Nolan, Jr.
(74) *Attorney, Agent, or Firm*—Marshall, Gerstein & Borun

(57) ABSTRACT

A printing press may be provided with a first rotatable printing roller that prints ink of a first color on a web of material and causes a first pair of registration marks to be periodically printed in the first color on the web, a second rotatable printing roller that prints ink of a second color on the web of material and causes a second pair of registration marks to be periodically printed in the second color on the web, a third rotatable printing roller that prints ink of a third color on the web of material and causes a third pair of registration marks to be periodically printed in the third color on the web, an imaging device positioned to detect the registration marks printed on the web that generates image data representing the registration marks, and a controller operatively coupled to the printing rollers and the imaging device. The controller may include a processor and a memory, and the controller may be programmed to identify the pairs of registration marks based on the image data and based on registration mark reference data for at least three registration mark pairs defined by a registration mark relationship table.

30 Claims, 4 Drawing Sheets

U.S. PATENT DOCUMENTS

| | | | | | |
|---|---|---|---|---|---|
| 4,391,190 | A | | 7/1983 | Metzler | 101/211 |
| 4,437,402 | A | | 3/1984 | Fischer | 101/181 |
| 4,484,522 | A | | 11/1984 | Simeth | 101/248 |
| 4,485,447 | A | | 11/1984 | Ericsson | 364/469 |
| 4,495,582 | A | | 1/1985 | Dessert et al. | 364/469 |
| 4,528,630 | A | * | 7/1985 | Sargent | 101/181 |
| 4,531,828 | A | | 7/1985 | Hoshino | 355/3 SH |
| 4,553,478 | A | | 11/1985 | Greiner et al. | 101/426 |
| 4,685,139 | A | | 8/1987 | Masuda et al. | 382/1 |
| 4,694,749 | A | | 9/1987 | Takeuchi et al. | 101/426 |
| 4,743,768 | A | | 5/1988 | Watanabe | 250/556 |
| 4,805,111 | A | | 2/1989 | Steidel | 364/469 |
| 4,872,407 | A | | 10/1989 | Banke | 101/389.1 |
| 4,994,975 | A | | 2/1991 | Minschart | 364/469 |
| 5,020,006 | A | | 5/1991 | Sporon-Fiedler | 364/550 |
| 5,056,430 | A | | 10/1991 | Bayerlein et al. | 101/211 |
| 5,123,887 | A | | 6/1992 | Shimura | 493/34 |
| 5,138,667 | A | * | 8/1992 | Roch et al. | 101/181 |
| 5,179,897 | A | | 1/1993 | Liebregts | 101/129 |
| 5,209,161 | A | | 5/1993 | Derivi et al. | 101/211 |
| 5,215,011 | A | | 6/1993 | Monney | 101/181 |
| 5,252,838 | A | | 10/1993 | Timblin | 250/561 |
| 5,272,980 | A | | 12/1993 | Takeuchi et al. | 101/481 |
| 5,455,764 | A | | 10/1995 | Meihofer | 364/161 |
| 5,551,339 | A | | 9/1996 | Schadlich et al. | 101/216 |
| 5,649,484 | A | | 7/1997 | Broghammer et al. | 101/248 |
| 5,771,811 | A | | 6/1998 | Siler et al. | 101/486 |
| 5,828,075 | A | | 10/1998 | Siler et al. | 250/259.44 |
| 5,917,192 | A | | 6/1999 | Siler et al. | 250/559.44 |
| 6,026,172 | A | * | 2/2000 | Lewis et al. | 250/559.01 |

* cited by examiner

REGISTRATION SYSTEM FOR PRINTING PRESS

BACKGROUND OF THE INVENTION

The present invention is directed to a registration system for a printing press and to a method of registering the printing rollers of a printing press.

There are various types of conventional printing presses. One conventional printing press includes a first rotatable printing roller that prints ink of a first color on a web of material and causes a first registration mark to be periodically printed in the first color on the web, a second rotatable printing roller that prints ink of a second color on the web and causes a second registration mark to be periodically printed in the second color on the web, and a third rotatable printing roller that prints ink of a third color on the web and causes a third registration mark to be periodically printed in the third color on the web. The phase or registration of the printing rollers is controlled to cause a multicolor image to be printed on the web, the multicolor image being composed of the single-color images or image portions printed by each printing roller. To that end, the conventional printing press includes an imaging device positioned to detect the registration marks printed on the web by said printing rollers that generates image data representing the registration marks and a controller operatively coupled to the printing rollers and the imaging device that generates a control signal that adjusts the phase or registration of the printing rollers so that they are in proper phase or registration.

One example of a printing press with a registration system is disclosed in U.S. Pat. No. 5,056,430 to Bayerlein, et al. As shown in FIG. 1 of the patent, that printing press is shown to be provided with four printing rollers that include printing plates 12, 13, 14, 16 each of which prints in a different color and each of which periodically prints a registration mark having a different size, as shown in FIG. 3 of the patent. After the registration marks are printed on the web, they are detected by an imaging detecting device 22, as shown in FIG. 4, that is used to measure deviations in the positions of the registration marks relative to each other. Those deviations are used to generate correction signals for correcting the registration of the printing rollers so that the multicolor image is in proper registration.

SUMMARY OF THE INVENTION

In one aspect, the invention is directed to a printing press that may be provided with a first rotatable printing roller that prints ink of a first color on a web of material and causes a first pair of registration marks to be periodically printed in the first color on the web, a second rotatable printing roller that prints ink of a second color on the web of material and causes a second pair of registration marks to be periodically printed in the second color on the web, a third rotatable printing roller that prints ink of a third color on the web of material and causes a third pair of registration marks to be periodically printed in the third color on the web, an imaging device positioned to detect the registration marks printed on the web that generates image data representing the registration marks, and a controller operatively coupled to the printing rollers and the imaging device.

The controller may include a processor and a memory, and the controller may be programmed to identify the pairs of registration marks based on the image data and based on registration mark reference data for at least three registration mark pairs defined by a registration mark relationship table set forth below:

| Pair | Offset X | Offset Y |
|---|---|---|
| Color A | 0 | 8 |
| Color B | 8 | 0 |
| Color C | 12 | −6 |
| Color D | 12 | 6 |
| Color E | 6 | −12 |
| Color F | 6 | 12 |
| Color G | 20 | −4 |
| Color H | 20 | 4 |
| Color I | 4 | −20 |
| Color J | 4 | 20 |

wherein the Offset X value for each of the registration mark pairs corresponds to an offset value in a first direction between the registration marks in the registration mark pair, and wherein the Offset Y value for each of the registration mark pairs corresponds to an offset value in a second direction between the registration marks in the registration mark pair, the second direction being perpendicular to the first direction.

In another aspect, the invention is directed to a controller for a printing press that may include a processor, a memory operatively coupled to the processor, and a computer program stored in the memory and executed by the processor. The computer program may cause the processor to identify a pair of printed registration marks based on image data generated from detection of the printed registration marks and based on registration mark reference data for at least three registration mark pairs defined by a registration mark relationship table set forth below:

| Pair | Offset X | Offset Y |
|---|---|---|
| Color A | 0 | 8 |
| Color B | 8 | 0 |
| Color C | 12 | −6 |
| Color D | 12 | 6 |
| Color E | 6 | −12 |
| Color F | 6 | 12 |
| Color G | 20 | −4 |
| Color H | 20 | 4 |
| Color I | 4 | −20 |
| Color J | 4 | 20 |

wherein the Offset X value for each of the registration mark pairs corresponds to an offset value in a first direction between the registration marks in the registration mark pair, and wherein the Offset Y value for each of the registration mark pairs corresponds to an offset value in a second direction between the registration marks in the registration mark pair, the second direction being perpendicular to the first direction.

The invention is also directed to a method which may include printing a first pair of registration marks in a first color on a web of material with a first rotatable printing roller, printing a second pair of registration marks in a second color on the web of material with a second rotatable printing roller, printing a third pair of registration marks in a third color on the web of material with a third rotatable printing roller. The method may also include generating image data representing the registration marks printed on the web by the printing rollers and identifying the pairs of registration marks based on the image data and based on registration mark reference data for at least three registration mark pairs defined by a registration mark relationship table set forth below:

| Pair | Offset X | Offset Y |
|---|---|---|
| Color A | 0 | 8 |
| Color B | 8 | 0 |
| Color C | 12 | −6 |
| Color D | 12 | 6 |
| Color E | 6 | −12 |
| Color F | 6 | 12 |
| Color G | 20 | −4 |
| Color H | 20 | 4 |
| Color I | 4 | −20 |
| Color J | 4 | 20 |

wherein the Offset X value for each of the registration mark pairs corresponds to an offset value in a first direction between the registration marks in the registration mark pair, and wherein the Offset Y value for each of the registration mark pairs corresponds to an offset value in a second direction between the registration marks in the registration mark pair, the second direction being perpendicular to the first direction.

In another aspect, the invention is directed to a printing press that may have a first rotatable printing roller that prints ink of a first color on a web of material and causes a first pair of registration marks to be periodically printed in the first color on the web, a second rotatable printing roller that prints ink of a second color on the web of material and causes a second pair of registration marks to be periodically printed in the second color on the web, a third rotatable printing roller that prints ink of a third color on the web of material and causes a third pair of registration marks to be periodically printed in the third color on the web, an imaging device positioned to detect the registration marks printed on the web that generates image data representing the registration marks, and a controller operatively coupled to the printing rollers and the imaging device.

The controller may include a processor and a memory, and the controller may be programmed to group the registration marks in pairs based on the image data by generating a list of possible registration mark pairs and by eliminating from the list at least one of the possible registration mark pairs. The controller may be programmed to determine a centerpoint for each of the pairs of registration marks, and the controller may also be programmed to generate a registration correction value for one of the printing rollers based on a plurality of the centerpoints.

The invention is also directed to a method that may include printing a first pair of registration marks in a first color on a web of material with a first rotatable printing roller, printing a second pair of registration marks in a second color on the web of material with a second rotatable printing roller, printing a third pair of registration marks in a third color on the web of material with a third rotatable printing roller, generating image data representing the registration marks printed on the web by the printing rollers, and grouping the registration marks in pairs based on the image data by generating a list of possible registration mark pairs and by eliminating from the list at least one of the possible registration mark pairs.

In a further aspect, the invention is directed to a printing press that may include a first rotatable printing roller that prints ink of a first color on a web of material and that causes a first pair of registration marks to be periodically printed in the first color on the web, a second rotatable printing roller that prints ink of a second color on the web of material and causes a second pair of registration marks to be periodically printed in the second color on the web, a third rotatable printing roller that prints ink of a third color on the web of material and causes a third pair of registration marks to be periodically printed in the third color on the web, an imaging device positioned to detect the registration marks printed on the web by the printing rollers that generates image data representing the registration marks, and a controller operatively coupled to the printing rollers and the imaging device. The controller may have a processor and a memory, and the controller may be programmed to determine an offset value between a first registration mark in one of the pairs of registration marks and a second registration mark in the one pair of registration marks, the offset value being determined based upon a dimension of one of the registration marks.

The invention is also directed to a method that may include printing a first pair of registration marks in a first color on a web of material with a first rotatable printing roller, printing a second pair of registration marks in a second color on the web of material with a second rotatable printing roller, printing a third pair of registration marks in a third color on the web of material with a third rotatable printing roller, generating image data representing the registration marks printed on the web by the printing rollers, and determining an offset value between a first registration mark in one of the pairs of registration marks and a second registration mark in the one pair of registration marks, the offset value being determined based upon a dimension of one of the registration marks.

In another aspect, the invention is directed to a printing press that may be provided with a first rotatable printing roller that prints ink of a first color on a web of material and causes a first registration mark to be periodically printed in the first color on the web, a second rotatable printing roller that prints ink of a second color on the web of material and causes a second registration mark to be periodically printed in the second color on the web, a third rotatable printing roller that prints ink of a third color on the web of material and causes a third registration mark to be periodically printed in the third color on the web, an imaging device positioned to detect the registration marks printed on the web by the printing rollers that generates image data representing the registration marks, and a controller operatively coupled to the printing rollers and the imaging device. The controller may include a processor and a memory, and the controller may be programmed to generate a registration correction value for one of the printing rollers based on data indicative of a spacing between a plurality of the registration marks and based on a dimension of at least one of the registration marks.

The invention is also directed to a method that may include printing a first registration mark in a first color on a web of material with a first rotatable printing roller, printing a second registration mark in a second color on the web of material with a second rotatable printing roller, printing a third registration mark in a third color on the web of material with a third rotatable printing roller, generating image data representing the registration marks printed on the web by the printing rollers, and generating a registration correction value for one of the printing rollers based on data indicative of a spacing between a plurality of the registration marks and based on a dimension of at least one of the registration marks so that the registration correction value may be generated regardless of the size of the registration marks.

The features and advantages of the present invention will be apparent to those of ordinary skill in the art in view of the detailed description of various embodiments, which is made with reference to the drawings, a brief description of which is provided below.

DETAILED DESCRIPTION OF VARIOUS EMBODIMENTS

Figure 1:
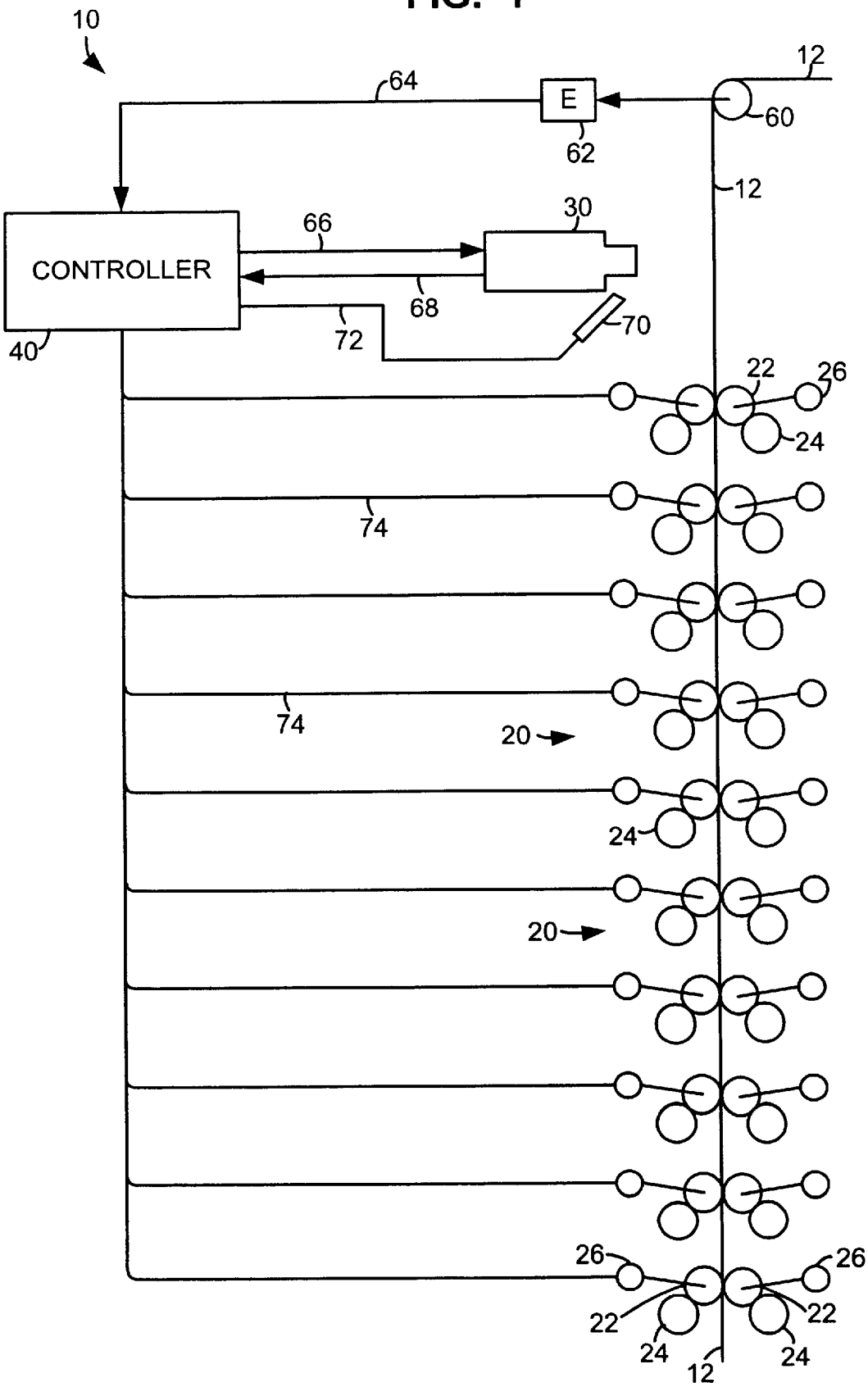
FIG. 1 illustrates an embodiment of a printing press in accordance with the invention.

FIG. 1 illustrates one embodiment of a printing press 10 in accordance with the invention. Referring to FIG. 1, the printing press 10 may be used to print multi-color images on a web 12, such as a paper web, with a plurality of printing stations 20. Each of the printing stations 20 may be used to print an image or image portion having a unique color on the web 12. Thus, where the web 12 will have an overall image composed of eight different colors, eight printing stations 20 may be used.

Each of the printing stations 20 may be designed to print only one side of the web 12, such as where cardboard product packaging is being printed (e.g. cardboard used for boxes of laundry detergent). Such a printing station 20 may include a rotatable printing roller 22 that makes contact with one side of the web 12, a rotatable ink roller 24 that makes contact with the printing roller 22 and supplies ink to the printing roller 22, and an ink reservoir (not shown) that supplies ink to the ink roller 24. Although each printing station 20 is shown to include only one ink roller 24, it should be understood that multiple ink rollers 24 may be used in each printing station 20. Alternatively, the printing stations 20 may be designed to print both sides of the web 12, such as where the web 12 is being printed for use as pages of a magazine.

Although a specific type of printing station 20 is shown in FIG. 1, it should be understood that other types of printing stations 20 may be used. For example, the printing press 20 could be provided as a rotogravure printing press, in which case rotogravure printing rollers would be utilized. Instead of using ink rollers 24, other types of ink application devices could be used. For example, each of the printing rollers 22 could be positioned at least partially within a respective ink reservoir, and a doctor blade could be utilized to remove excess ink.

Each printing station 20 may include a phase adjustment mechanism 26 to allow control of the alignment or phase registration of the color image printed by the printing station 20 relative to the color images printed by the other printing stations 20. Where the printing rollers 22 of the printing press 10 are rotatably driven by a common drive motor and a common drive shaft, such a phase adjustment mechanism may be provided in the form of a differential gear box that allows the phase of each printing roller 22 to be adjusted. Alternatively, the phase adjustment mechanism 26 could be provided in the form of an independently controllable, separate drive motor for each printing roller 22. The phase adjustment mechanism 26 for each printing roller 22 could be provided in other forms, and the details of the phase adjustment mechanism are not considered important to the invention. Regardless of how it is provided, the phase adjustment mechanism 26 simply allows the phase, or rotational position, of each of the printing rollers 22 to be independently adjusted.

The phase adjustment mechanism 26 for each printing roller 22 could be capable of adjusting the registration of the printing roller 22 in two perpendicular directions, such as a first direction parallel to the direction of travel of the web 12 and a second direction perpendicular to the direction of travel of the web 12.

In order to detect whether the printing performed by each of the printing stations 20 is properly aligned or registered, each of the printing rollers 22 may be designed to print a pair of registration marks in addition to the image that is to be printed. The printing press 10 may be provided with an imaging device 30 that may be positioned adjacent the web 12 and used to periodically detect the registration marks printed by the printing rollers 22 and generate image data representing the registration marks. As described in further detail below, that image data may be analyzed by a controller 40 to determine whether one or more of the printing rollers 22 is out of phase with the others and, if so, to generate registration correction data to cause one or more of the phase adjustment mechanisms 26 to bring the printing roller(s) 22 back into proper phase with the others so that all of the colors of the final image printed on the web 12 are in proper alignment.

FIG. 1 illustrates a printing press 10 that prints both sides of the web 12, and each of the printing stations 20 includes a pair of printing rollers 22, one that prints on each side of the web 12. Where only one side of the web 12 is to be printed, each of the printing stations 20 could include a printing roller 22 and an ink roller 24 on one side of the web 12 and a rotatable backing roller (not shown) on the opposite side of the web 12. The backing roller could be aligned with the printing roller 22 to provide a surface against which the web 12 would be pressed by the printing roller 22. Numerous other modifications of the printing press 10 shown in FIG. 1 could be made.

Registration Mark Pattern

Figure 2:
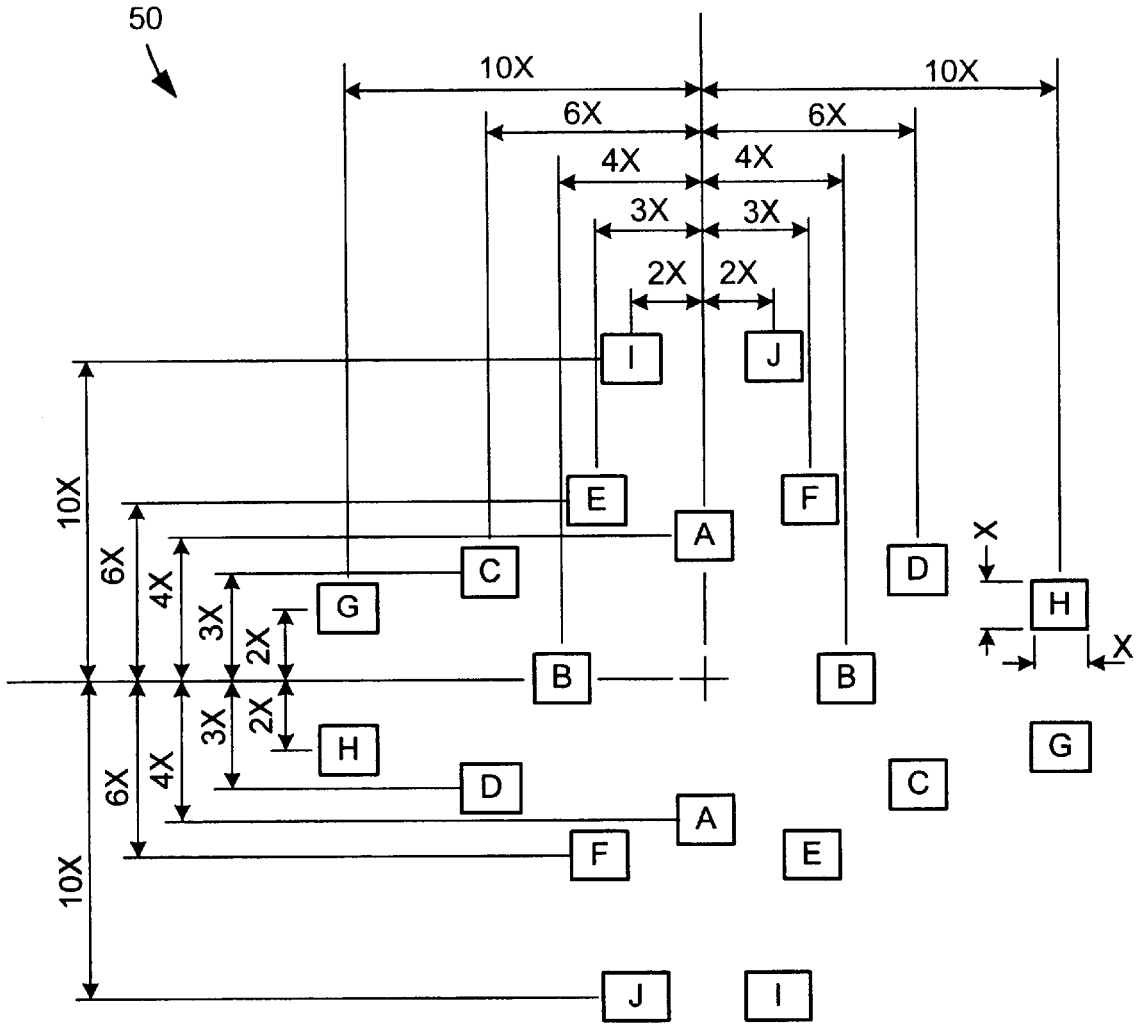
FIG. 2 is one example of a registration mark pattern in accordance with the invention.

FIG. 2 illustrates one example of a registration mark pattern 50 in accordance with the invention. Referring to FIG. 2, the registration mark pattern 50 may include 10 pairs of registration marks, with each pair of registration marks being printed by a respective one of the printing rollers 22. Since each pair of registration marks printed by each printing roller 22 is fixed relative to the image printed by that printing roller 22, proper alignment of the registration marks will necessarily result in proper alignment of the images printed by the printing rollers 22.

FIG. 2 illustrates the registration mark pattern 50 as it would appear if all of the printing rollers 22 were in perfect phase or registration. Referring to FIG. 2, each registration mark is disposed at a position relative to a center point, which is indicated by the symbol "+" in FIG. 2. Each registration mark has an X offset value and a Y offset value associated therewith, the X offset value corresponding to a distance in the x- or horizontal direction and the Y offset value corresponding to a distance in the y- or vertical direction. Although it is stated herein that the X and Y offset values "correspond" to a distance, it should be noted that such values are not measured in units of distance such as inches or millimeters. Instead, the X and Y offset values are set forth in terms of multiples (e.g. 2× or 10×) of the width or height of the registration marks.

The registration mark pattern of FIG. 2 includes two registration marks designated "A," one of the "A" registration marks being positioned directly above the center point "+" and the other "A" registration mark being positioned directly below the center point. As shown in FIG. 2, the upper "A" registration mark is positioned four units (i.e. 4×) above the center point, and the lower "A" registration mark is positioned four units below the center point, where "X" is equal to the height of the "A" registration marks. The two "A" registration marks can also be defined in terms of their positions relative to each other in the x and y directions noted above. In particular, the "A" registration marks can be described as having an offset x value of zero (since the "A" registration marks are aligned vertically) and an offset y value of eight (since the "A" registration marks are spaced apart vertically by a distance equal to eight times their height). FIG. 2 sets forth the precise position of each of the registration marks relative to the center point of the registration mark pattern, as set forth in the following table:

TABLE 1

| Mark | Position X | Position Y |
|---|---|---|
| A | 0 | 4 |
| A | 0 | −4 |
| B | −4 | 0 |
| B | 4 | 0 |
| C | −6 | 3 |
| C | 6 | −3 |
| D | −6 | −3 |
| D | 6 | 3 |
| E | −3 | 6 |
| E | 3 | −6 |
| F | −3 | −6 |
| F | 3 | 6 |
| G | −10 | 2 |
| G | 10 | −2 |
| H | −10 | −2 |
| H | 10 | 2 |
| I | −2 | 10 |
| I | 2 | −10 |
| J | −2 | −10 |
| J | 2 | 10 |

It should be noted that, for the registration mark pattern 50 shown in FIG. 2, the centerpoints of each pair of registration marks are all aligned at the centerpoint of the registration mark pattern 50. That is, for each pair of registration marks shown in FIG. 2, the midpoint of a line passing through the centers of each pair of registration marks coincides with the centerpoint (i.e. the "+" symbol) of the registration mark pattern 50. Consequently, when the registration mark pattern 50 of FIG. 2 is used, the misalignment of one pair of registration marks relative to another pair of registration marks can be readily detected by determining whether or not the centers of each pair of registration marks coincide with each other, as described in more detail below.

Although the registration mark pattern 50 shown in FIG. 2 may be convenient to use since alignment or misalignment of pairs of registration marks is readily apparent, numerous other registration mark patterns may be utilized. As just one of many examples, a modified registration mark pattern may be designed by simply (and arbitrarily) moving any one of the pairs of registration marks a given distance, for example, in either the x or y direction or in an angled direction. For example, the pair of "A" registration marks could be moved one-half of an inch to the left in FIG. 2A. Consequently, if that modified pattern were used as a reference in order to detect misregistration, when all of the registration mark pairs were in perfect alignment, the center of each pair would coincided with the centerpoint "+," except for the centerpoint of the moved "A" pair, which would be one-half of an inch to the left of all of the other centerpoints. However, the modified pattern would still allow the controller 40 to achieve registration of all of the printing rollers 22.

Regardless of the relative position of each registration mark pair within the registration mark pattern 50, the two registration marks in each pair may have the same position relative to each other. For example, if the "A" registration marks were moved one-half of an inch to the left in FIG. 2 as suggested above, the "A" registration marks would still have the same position relative to each other as before: the "A" registration marks would be aligned in a vertical line, and they would be spaced apart by a distance equal to eight times their width (or height since the marks are square). The following table defines, for each pair of registration marks, the position of the registration marks relative to each other (the position of the marks relative to each other is fixed and does not vary, regardless of any misregistration):

TABLE 2

| Pair | Offset X | Offset Y |
|---|---|---|
| A | 0 | 8 |
| B | 8 | 0 |
| C | 12 | −6 |
| D | 12 | 6 |
| E | 6 | −12 |
| F | 6 | 12 |
| G | 20 | −4 |
| H | 20 | 4 |
| I | 4 | −20 |
| J | 4 | 20 |

In the above table, the Offset X value for each of the registration mark pairs corresponds to the horizontal spacing (in units of registration mark widths) between the two registration marks of the pair, and the Offset Y value for each of the registration mark pairs corresponds to the vertical spacing (in units of registration mark heights) between the two registration marks of the pair. Thus, the "A" registration marks of FIG. 2 have an offset X value of zero since they are vertically aligned and an offset Y value of eight units since they are spaced apart by that distance in the "y" or vertical direction.

The registration mark pattern 50 shown in FIG. 2 and the numerous possible modifications of that pattern described above include 10 pairs of registration marks. Where the printing press 10 includes fewer than ten printing rollers 22 for each side of the web 12 being printed, a registration mark pattern may be used that includes fewer than ten pairs of registration marks.

For example, where four colors are being printed on a side of the web 12 with four separate printing rollers 22, four pairs of registration marks could be used, with each pair being printed by one of the four printing rollers 22. The four pairs of registration marks could be positioned to coincide with the position of any four of the ten pairs of registration marks of the registration mark pattern 50 of FIG. 2.

For example, the first pair of registration marks could be positioned to coincide with the "B" registration marks in FIG. 2; the second pair of registration marks could be positioned to coincide with the "E" registration marks in FIG. 2; the third pair of registration marks could be positioned to coincide with the "C" registration marks in FIG. 2; and the fourth pair of registration marks could be positioned to coincide with the "H" registration marks in FIG. 2.

Alternatively, the four pairs of registration marks could be positioned to coincide with the positions of any four registration mark pairs shown in FIG. 2. Thus, the registration mark pattern 50 shown in FIG. 2 could be utilized for any number of pairs of registration marks from two pairs to ten pairs.

Alternatively, the four pairs of registration marks could be positioned in positions different than any of the registration marks shown in FIG. 2, while retaining the same spatial relationship between the two registration marks of each pair described in Table 2 above.

Detection of Registration Mark Pattern

Figure 3:
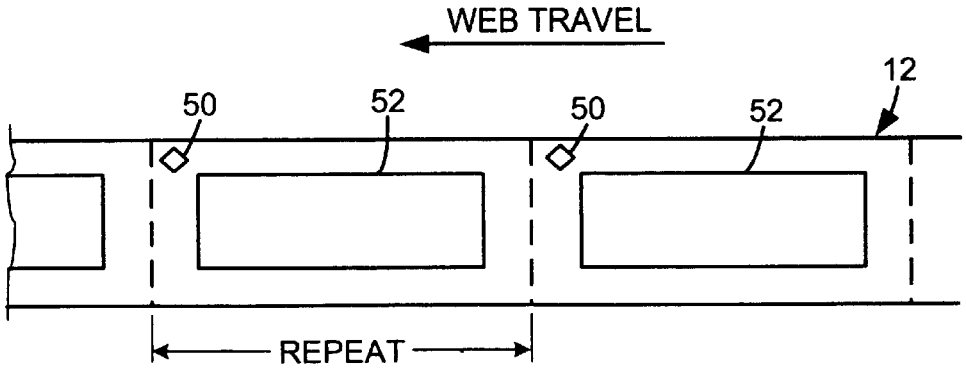
FIG. 3 illustrates a portion of a web after it has been printed.

FIG. 3 illustrates a portion of the web 12 after it has been printed by the printing press 10. Referring to FIG. 3, the web 12 has a plurality of printed repeat lengths, each of which is equal to the circumference of one of the printing rollers 22. One of the registration mark patterns 50 (schematically shown as a diamond) and a multi-color image 52 (schematically shown as a rectangle) may be printed within each repeat length of the web 12. Although the registration mark patterns 50 are shown in FIG. 3 to lie outside the boundary of the multi-color image 52 for sake of clarity, the registration mark patterns 50 could be printed anywhere within the image 52. The imaging device 30 (FIG. 1) is used to detect the presence of each registration pattern 50 that is printed, and based upon image data generated therefrom, the controller 40 causes the phase adjustment mechanisms 26 to keep the printing rollers 22 in proper registration.

In order to detect each registration mark pattern 50, the imaging device 30 may be periodically activated or triggered at a predetermined time. The imaging device 30 may be, for example, a camera having a field of view that is a multiple of the width of the registration mark pattern 50. The imaging device 30 may be periodically triggered so that it generates an image when the registration mark pattern 50 is positioned within its field of view.

Referring to FIG. 1, the printing press 10 may include a rotatable cylinder 60 that makes non-slip contact with the moving web 12 and that may be used as a reference cylinder. The reference cylinder 60 may be provided with the same outer circumference as that of each of the printing rollers 22 so that a given angular rotation of the reference cylinder 60 would correspond to the same amount of web travel as the same angular rotation of each of the printing rollers 22. An encoder 62 may be operatively coupled to the reference cylinder 60, and the encoder 62 may generate a signal or pulse representative of the angular position of the reference cylinder 60.

The signal or pulse generated by the encoder 62 may simply indicate when the reference cylinder 60 has reached a predetermined angular position, such as for example, when the reference cylinder 60 occupies the position at which one of the registration mark patterns 50 would be positioned within the field of view of the imaging device 30. Alternatively, the signal or pulse generated by the encoder 62 may simply indicate when the reference cylinder 60 has reached the position corresponding to the start of one of the repeat lengths (i.e. the start of a repeat length being indicated by one of the dotted lines shown in FIG. 3). Alternatively, where the pulse or signal from the encoder 62 continuously indicates the current angular position of the reference cylinder 60, the encoder pulse or signal could be used to generate a trigger signal when the reference cylinder 60 reached a predetermined position, e.g. the start of repeat, as described above.

Referring to FIG. 1, the signal or pulse generated by the encoder 62 may be transmitted to the controller 40 via a line 64. In response to that signal, the controller 40 may generate and transmit a trigger pulse to the imaging device 30 via a line 66. After being triggered, imaging data generated by the imaging device 30 may be transmitted to the controller 40 via a data line 68. Where the imaging device 30 comprises a camera having a shutter speed that is slower than desired, a strobe light 70 may be used to illuminate the web 12 for a period of time shorter than the time which the shutter of the camera 30 remains open in order to reduce any blur of the image generated by the camera 30. If used for that purpose or for any other purpose, the strobe light 70 may be activated by a trigger signal or pulse generated by the controller 40 and transmitted to the strobe light 70 via a line 72. As described below, the controller 40 may cause the registration of the printing rollers 22 to be adjusted by transmitting a separate phase or registration adjustment signal to each of the phase correction devices 26 via a plurality of signal lines 74. Although not shown in FIG. 1 for purposes of simplicity, it should be understood that, where the right-hand side of the web 12 is printed via printing rollers 22, the phase adjustment devices 26 on the right hand side of the web 12 would also be connected to signal lines 74 connected to the controller 40.

For purposes of simplicity, FIG. 1 does not show an imaging device 30 and a strobe light 70 positioned on the right-hand side of the web 12. Obviously, where both sides of the web 12 are printed and where each printing station includes a printing roller 22 for each side of the web 12, the printing press 10 may also include an imaging device 30 positioned to periodically detect the registration mark patterns printed by the right-hand printing rollers 22 and may also include a strobe light 70 positioned to illuminate the right-hand side of the web 12. The right-hand imaging device 30 and the right-hand strobe 70 would be connected to the controller 40 and operate in the same manner as the imaging 30 and the strobe light 70 shown in FIG. 1.

The Controller 40

Figure 4:
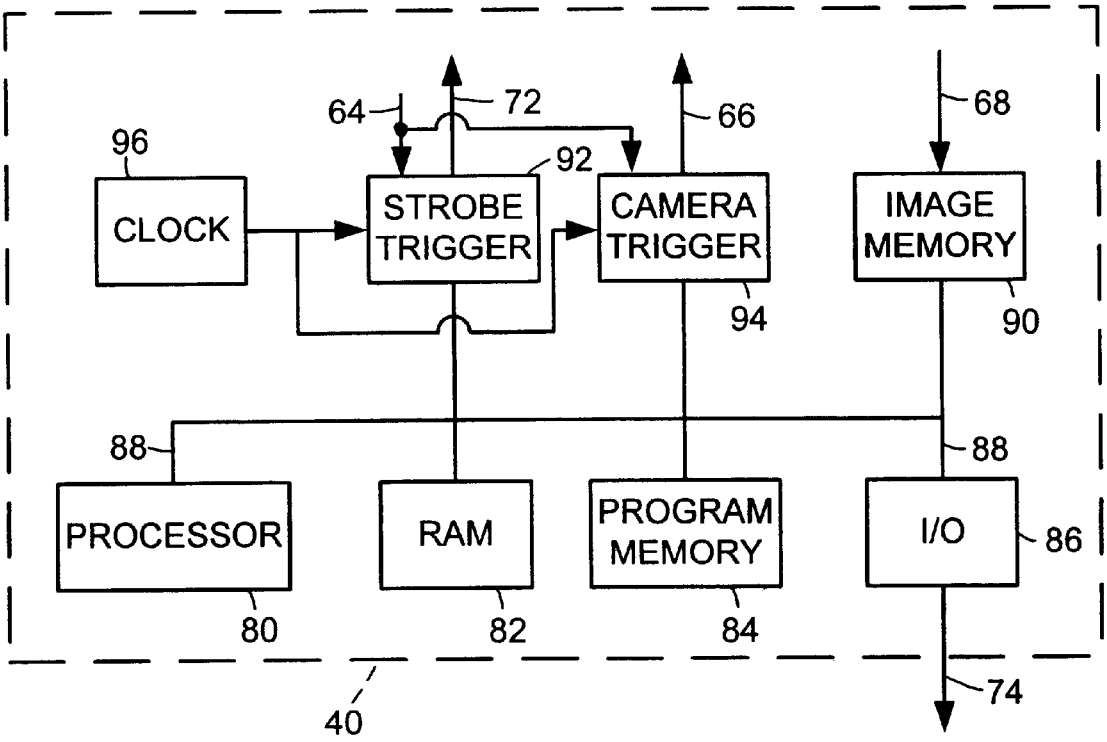
FIG. 4 is a block diagram of one embodiment of the controller shown schematically in FIG. 1.

FIG. 4 is a block diagram of one possible embodiment of the controller 40 shown schematically in FIG. 1. Referring to FIG. 4, the controller 40 may include a microcontroller or microprocessor (MP) 80, a random-access memory (RAM) 82, a program memory (ROM) 84, and an input/output (I/O) circuit 86, all of which may be interconnected via an address/data bus 88. It should be appreciated that although only one microprocessor 80 is shown, the controller 40 could include multiple microprocessors 80. Similarly, the memory of the controller 40 could include multiple RAMs 82 and multiple program memories 84. Although the I/O circuit 86 is shown as a single block, it should be appreciated that the I/O circuit 86 could include a number of different types of I/O circuits. The RAM(s) 82 and program memory (ies) 84 could be implemented as semiconductor memories, magnetically readable memories, and/or optically readable memories, for example.

The controller 40 may include an image memory 90 in which image data generated by the imaging device 30 is stored. The controller 40 may also include a strobe trigger circuit 92, a camera trigger circuit 94 and a clock circuit 96 operatively coupled to those circuits 92, 94. The camera trigger circuit 94 may be used to generate a trigger signal that triggers the imaging device 30 to image the web 12, with the trigger signal being generated based upon a clock signal generated by the clock circuit 96 and the signal generated by the encoder 62 and transmitted to the camera trigger circuit 94 via the line 64. The strobe trigger circuit 92 may be used to generate a trigger signal that triggers the strobe light 70 to illuminate the portion of the web 12 in the field of view of the imaging device 30, with the strobe trigger signal being generated based upon the clock signal generated by the clock circuit 96 and the signal generated by the encoder 62 and transmitted to the strobe trigger circuit 92 via the line 64.

Each of the trigger circuits 92, 94 could have various designs. As just one example, the camera trigger circuit 94 could include a counter (not shown) that continuously counts (either up or down) in accordance with encoder pulses (indicative of travel of the web 12) generated by the encoder 62 and transmitted via the line 64. The counter could be reset to zero (or another predetermined count) upon receiving a signal from the encoder 62, such as once-per-revolution reference or "Z" pulse, or a signal generated from the encoder signal. The trigger signal on the line 66 could be generated upon the counter reaching a predetermined count (e.g. a nonzero count if the counter is counting up or a zero count if the counter is counting down). For example, if the encoder 62 generates a pulse or signal that corresponds with the start of repeat (FIG. 3), then the predetermined count which triggers the imaging device 30 could be based on the relatively short distance (see FIG. 3) between the start of repeat and the registration mark pattern 50 and the web travel speed. The particular manner of triggering the imaging device 30 and the strobe 70, if used, is not considered important to the invention, and numerous other ways and circuit designs could be utilized.

Registration Routine

Figure 6:
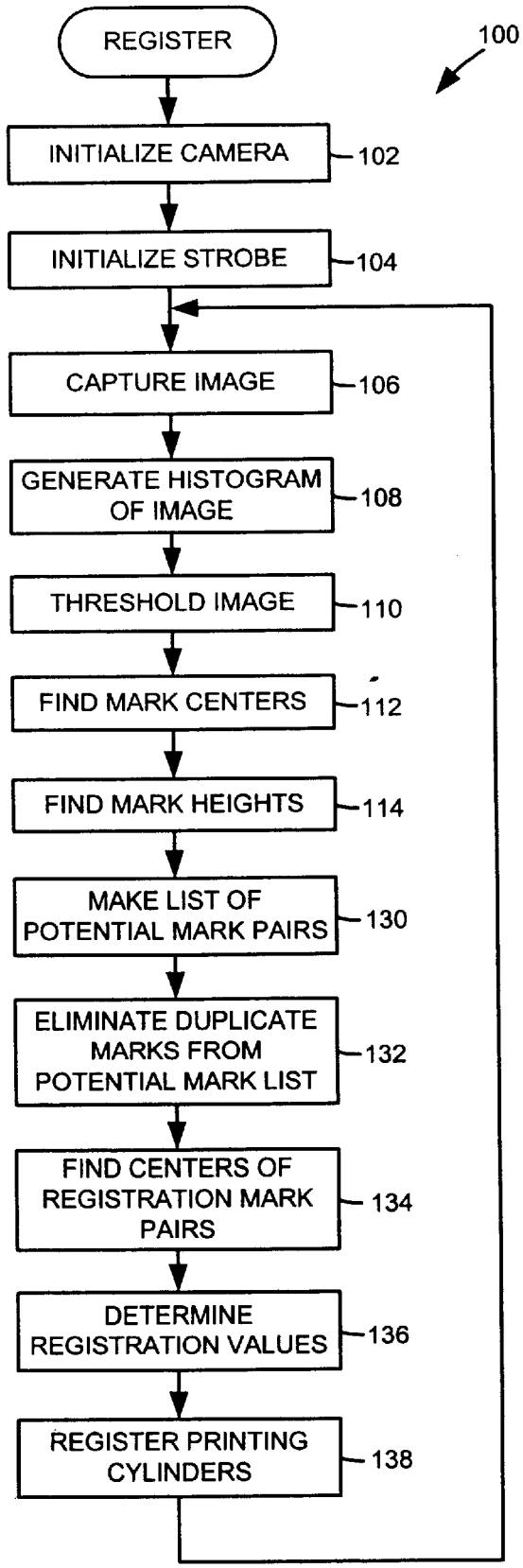
FIG. 6 is a flowchart of one embodiment of a computer program that may be used to control the operation of the printing press of FIG. 1.

FIG. 6 illustrates a flowchart of one possible embodiment of a register routine 100 that could be performed to maintain proper registration of all of the printing rollers 22 of the printing press 10. The registration routine 100 may be implemented by one or more computer program portions stored in the program memory 84 (FIG. 4) and executed by the processor 80. Referring to FIG. 6, at block 102 the imaging device 30 may be initialized, if necessary, in a conventional manner that depends upon the particular imaging device 30 that is used. At block 104, the strobe light 70 may be initialized, if necessary and if a strobe light is used, in a conventional manner that depends upon the particular strobe light 70 that is used.

At block 106, upon the imaging device 30 being triggered as described above, an image of the registration mark pattern 50 on the web 12 is generated, and image data corresponding to the sensed registration mark pattern 50 is stored in the controller 40, such as in the image memory 90. Where the imaging device 30 comprises a camera, the imaging data may comprise a numeric value corresponding to the light intensity for each x, y position (e.g. for each pixel) in the field of view of the camera.

Blocks 108 and 110 may be performed to simplify processing of the image data. At block 108, a histogram or frequency distribution of the image data may be generated. The histogram may be used as an aid to separate meaningful image data (i.e. image data generated as a result of registration marks) from data that is not meaningful (e.g. image data generated as a result of sensing the background color of the web 12). For example, assume that the image data for each pixel comprises a greyscale number indicative of the intensity of the image for that pixel. Also assume that the greyscale numbers may range from 0 to 127. The histogram may be generated by determining the number of pixels that have each of the possible greyscale values. In that case, for each possible intensity level the histogram would indicate the number of pixels having that intensity level.

Where the registration mark pattern 50 is printed on a web having a substantially constant background color, it may be expected that the histogram of the image data would produce a relatively large number (e.g. 90%) of pixels having an intensity level within a relatively narrow range (i.e. the intensity level range corresponding to the background color of the web 12).

At block 110, the image data may be "thresholded" by using the histogram or frequency distribution generated at block 108. The thresholding may be performed, for example, by assigned a zero intensity level to each of the relatively large number of pixels having an intensity level falling within the narrow range described above. As a consequence, image data generated by sensing the background color of the web 12 could effectively be ignored in further processing steps.

At block 112, the center of each of the individual registration marks may be located. Where each individual registration mark is square in shape, as shown in FIG. 2, the x, y coordinates corresponding to the center of each square registration mark may be determined. Determination of the center of a group of pixels is conventional. For example, the pixels belonging to each particular registration mark can be determined by locating all pixels having an intensity level within a relatively narrow range (with the intensity level depending on the color of the registration mark). Two different registration marks could be distinguished by successively assigning each pixel having that intensity level to either one of the marks or the other, depending on the x, y coordinates of that pixel.

After pixels have been assigned to a registration mark, the x, y coordinates of the center of that registration mark could be determined in various ways. For example, the x coordinates of the center could be determined by averaging the largest and smallest x coordinates of all the pixels of the registration mark, and the y coordinate could be determined in the same manner. The particular manner in which the centers of the registration marks are determined (if determined at all) is not considered either important or necessary to the invention. For example, instead of registering the printing rollers 22 based on the centers of the registration marks, the printing rollers 22 could be registered based on registration of the top left-hand corner of each of the registration marks.

At block 114, the height of the registration marks could be determined. The height of one of the registration marks could be determined by determining the difference between the largest and smallest y coordinates of the pixels forming to the registration mark. The height of each registration mark could be determined, and at block 114 the average height of all of the registration marks could be determined. instead of determining the height, another dimension of the registration marks could be determined at block 114, such as width or another cross-sectional distance or dimension. The height or other dimension of the registration marks may be used in analyzing the spacings of the registration marks so that such spacings are analyzed as a multiple of the width or height of the registration marks and not in terms of actual distances, such as inches or centimeters. In that case, the ability of the controller 40 to identify and differentiate the printed registration mark pair is independent of both the distance between the imaging device 30 and the web 12 and the actual size of the registration marks. Thus, for example, the controller 40 would be able to generate registration correction signals for registration marks having a predetermined size and for registration marks having twice that predetermined size.

Figure 5:
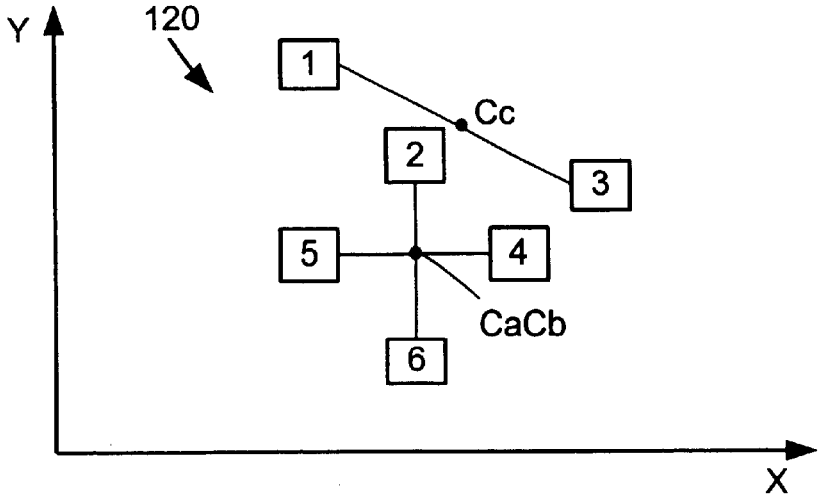
FIG. 5 illustrates an image of a registration mark pattern.

The description of the following portions of the registration routine 100 is made in connection with an image of an exemplary registration mark pattern 120 shown in FIG. 5 that is assumed to have been printed on the web 12. The pattern 120 is composed of a six registration marks designated "1" through "6." The spatial relationship of the "2" and "6" registration marks of the pattern 120 is the same as that of the "A" registration marks of the pattern 50 of FIG. 2; the spatial relationship of the "5" and "4" registration marks of the pattern 120 is the same as that of the "B" registration marks of the pattern 50 of FIG. 2; and the spatial relationship of the "1" and "3" registration marks of the pattern 120 is the same as that of the "C" registration marks of the pattern 50 of FIG. 2. It should be noted that the "1" and "3," registration marks within the pattern 120 image is significantly changed from the position of the "C" registration marks within the pattern 50, which is caused by misregistration of the printing roller 22 that printed to "C" registration marks.

Table 3 set forth below more precisely describes the image of the registration mark pattern 50 and specifies an x position for the center of each registration mark, a y position for the center of each registration mark, and the height of each registration mark (in FIG. 5, the x positions increase from left to right and the y positions increase from bottom to top). The values in the following table could represent numbers of pixels (where an x, y position of 0, 0 corresponds to the lower left hand corner of the image):

TABLE 3

| Mark | X | Y | Height |
|---|---|---|---|
| 1 | 382 | 625 | 8 |
| 2 | 414 | 593 | 8 |
| 3 | 478 | 577 | 8 |
| 4 | 446 | 561 | 8 |
| 5 | 382 | 561 | 8 |
| 6 | 414 | 529 | 8 |

Blocks 130 and 132 of the registration routine 100 may be performed to group the individual registration marks of the pattern 120 into pairs based upon the possible spatial orientations set forth in Table 2 above. At block 130, a list of potential registration mark pairs may be generated. The list of potential mark pairs may be generated, for example, by comparing the x and y spacing for each pair of registration marks in the pattern 120 (for six registration marks, there are 15 possible pairs) and comparing the x and y spacing for that pair with each of x and y spacings set forth in Table 2 above. If the x and y spacings correspond, that pair of registration marks is added to the list of potential registration mark pairs.

The example pattern 120 shown in FIG. 5 and defined by Table 3 may be analyzed at block 130 by first determining the x and y spacings between registration marks "1" and "2." Based on the values set forth in Table 3, those x and y spacings are 4 and −4 units, respectively (the x spacing is [414−382]/8 (height) and the y spacing is [593−625]/8). Those x and y spacings may then be compared to the x and y offset values set forth in Table 2 for each pair of registration marks. Since no pair of registration marks in Table 2 has x and y offset values of 4, −4, the potential pair of registration mark "1" and registration mark "2" (denoted pair "1:2") is not added to the list of potential pairs.

The next possible pair of registration marks is registration mark "1" and registration mark "3." The x and y spacings for this potential pair is determined to be 12 and −6 units, respectively (the x spacing is (478−382)/8 and the y spacing is (577−625)/8). These spacings are then compared with the x and y offset values for each pair in Table 2 above. Since Table 2 has one pair of registration marks (the "C" registration marks) having the x and y offset values of 12 and −6, the potential pair of registration mark "1" and registration mark "3," (denoted pair "1:3") is identified as a potential pair and is added to the list of potential pairs.

When the above process is repeated for each possible pair of registration marks, the list of potential registration mark pairs set forth in Table 4 below is generated. In addition to identifying the potential registration mark pairs, Table 4 indicates the mark pair of Table 2 to which the x and y spacings of the potential mark pair correspond. For example, since the x and y spacings of the potential mark pair 1:3 are 12 and −6, respectively, which correspond to the 12 and −6 offset values of Pair C in Table 2, pair C is set forth in Table 4 for that pair 1:3.

TABLE 4

| First Mark | Second Mark | Potential Pair |
|---|---|---|
| 1 | 3 | C |
| 5 | 1 | A |
| 5 | 4 | B |
| 6 | 2 | A |

Table 4 indicates that there are two possible pairs of marks that may correspond to the "A" registration mark pair of Table 2 and shown in FIG. 2. Those two possible mark pairs are 5:1 and 6:2. That should be apparent based on a comparison of the spatial relationship between the registration marks "5" and "1" as shown in FIG. 5 and the spatial relationship between the registration marks "6" and "2" as shown in FIG. 5. In both cases, one mark is directly below the other and spaced by a vertical distance of eight times the height of the mark, which is the same spatial relationship between the two "A" registration marks of FIG. 2. It should be understood that since the spacing between each pair of registration marks of FIG. 2 and defined by Table 2 is unique, only one of the pairs 5:1 and 6:2 of registration marks corresponds to the pair "A" in Table 2; due to misregistration of one of the printing rollers 22, the other two marks are spaced similarly to the marks "A" of Table 2 but actually belong to different pairs.

At block 132, duplicate pairs of registration marks may be eliminated from the list of potential registration mark pairs generated at block 130. One possible way of eliminating pairs from the list is based on the number of times a single registration mark appears in the list of potential mark pairs. Since a registration mark can only be part of a single pair, a registration mark that appears in multiple pairs in the list indicates that one of those pairs is erroneous. One possible manner of determining which of the pairs is erroneous involves assigning a score to each potential pair of registration marks. The score may be determined as the product of a pair of weighting factors, one for each registration mark. The weighting factor for a registration mark may be determined based on the number of times that the registration mark appears in the list of potential mark pairs.

TABLE 5

| First Mark | Second Mark | Potential Pair | Score |
|---|---|---|---|
| 1 | 3 | C | ½ × 1 = ½ |
| 5 | 1 | A | ½ × ½ = ¼ |
| 5 | 4 | B | ½ × 1 = ½ |
| 6 | 2 | A | 1 × 1 = 1 |

One possible weighting and scoring scheme is illustrated in Table 5 above. In that weighting scheme, each mark is assigned a weighting factor that is the inverse of the number of times that the mark appears in the list of potential mark pairs. Thus, a mark that appears once in the list of potential mark pairs may be assigned a weighting factor of 1; a mark that appears twice may be assigned a weighting factor of ½; a mark that appears three times may be assigned a weighting factor of ⅓; and so on. To score each potential mark pair, the weightings assigned to the registration marks of each potential pair are multiplied. A higher score means a higher probability that the potential mark pair corresponds to an actual pair of registration marks.

In accordance with that scheme, registration mark "1" in Table 5 is assigned a weighting factor of ½ since registration mark "1" appears twice in Table 5; registration mark "2" is assigned a weighting factor of 1 since registration mark "2" appears only once in Table 5; registration mark "3," is assigned a weighting factor of 1 since registration mark "3," appears only once in Table 5; registration mark "4" is assigned a weighting factor of 1 since registration mark "4" appears only once in Table 5; registration mark "5" is assigned a weighting factor of ½ since registration mark "5" appears twice in the list; and registration mark "6" is assigned a weighting factor of 1 since registration mark "6" appears only once in Table 5. The mark pair having the lowest score (which may be determined as the product of the weighting factors) may be eliminated from the list of potential mark pairs, leaving three actual mark pairs as set forth below in Table 6.

TABLE 6

| First Mark | Second Mark | Actual Pair |
|---|---|---|
| 1 | 3 | C |
| 5 | 4 | B |
| 6 | 2 | A |

At block 134, the x, y coordinates of the center of each pair of the registration marks may be determined. This may be determined by determining coordinates of the midpoint of the line segment joining the center point of one of the registration marks with the center point of the other registration mark. The centers that may be determined at block 134 are shown in FIG. 5 and designated $C_a$, $C_b$, $C_c$ (the centers $C_a$ and $C_b$ occupy the same point). For the above example (see Table 3 above), the centerpoints for the three pairs of registration marks are set forth below:

TABLE 7

| Pair | Centerpoint (X, Y) | |
|---|---|---|
| 1:3 | 430 | 601 |
| 5:4 | 414 | 561 |
| 6:2 | 414 | 561 |

At block 136, one or more registration correction values may be determined based on the centerpoints determined at block 134. In determining such correction values, one of the centerpoints may arbitrarily be selected as a reference centerpoint, and registration correction values may be generated based on variance of the other centerpoints relative to the reference centerpoint.

As one example, assume that the "5" and "4" registration marks were printed by the first or lowest printing roller 22 of FIG. 1 and assume that the centerpoint of those registration marks were used as a reference centerpoint. In that case, registration correction values of −16, −40 (414−430=−16, 561−601=−40) could be generated at block 136. The registration correction values could be translated into actual dimensions, such as inches or centimeters, based on the size (in inches or centimeters) of the printed registration marks. For the printing of any particular web using a particular set of printing rollers 20 or plates, the size of the printed registration marks would not vary, and data specifying the size of the registration marks could be entered into the controller 40.

At block 138, all of the registration correction values generated at block 136 could be transmitted to the corresponding phase adjustment mechanisms 26 for the printing rollers 22 so that the printing roller(s) 22 could be brought back into proper registration. In the above example, the printing roller 22 that printed the "1" and "3", registration marks could be brought back into registration by its associated phase adjustment mechanism 26 via the registration correction values for the 1:3 pair determined at block 136.

It should be noted that the registration routine 100 described above utilizes only the intensity, and not the color, of the image of the registration mark pattern detected by the imaging device 30. Consequently, the imaging device 30 may be provided in the form of a monochromatic imaging device (e.g. a black and white camera), and a color imaging device is unnecessary.

Numerous modifications and alterative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A printing press, comprising:

a first rotatable printing roller that prints ink of a first color on a web of material, said first printing roller causing a first pair of registration marks to be periodically printed in said first color on said web;

a second rotatable printing roller that prints ink of a second color on said web of material, said second printing roller causing a second pair of registration marks to be periodically printed in said second color on said web;

a third rotatable printing roller that prints ink of a third color on said web of material, said third printing roller causing a third pair of registration marks to be periodically printed in said third color on said web;

an imaging device positioned to detect said registration marks printed on said web by said printing rollers, said imaging device generating image data representing said registration marks; and a controller operatively coupled to said printing rollers and said imaging device, said controller comprising a processor and a memory, said controller being programmed to identify said pairs of registration marks based on said image data and based on registration mark reference data for at least three registration mark pairs defined by a registration mark relationship table set forth below:

| Pair | Offset X | Offset Y |
|---|---|---|
| Color A | 0 | 8 |
| Color B | 8 | 0 |
| Color C | 12 | −6 |
| Color D | 12 | 6 |
| Color E | 6 | −12 |
| Color F | 6 | 12 |
| Color G | 20 | −4 |
| Color H | 20 | 4 |
| Color I | 4 | −20 |
| Color J | 4 | 20 |

wherein said Offset X value for each of said registration mark pairs corresponds to an offset value in a first direction between said registration marks in said registration mark pair, and wherein said Offset Y value for each of said registration mark pairs corresponds to an offset value in a second direction between said registration marks in said registration mark pair, said second direction being perpendicular to said first direction.

2. A printing press as recited in claim 1, additionally comprising:

a fourth rotatable printing roller that prints ink of a fourth color on said web of material, said fourth printing roller causing a fourth pair of registration marks to be periodically printed in said fourth color on said web;

a fifth rotatable printing roller that prints ink of a fifth color on said web of material, said fifth printing roller causing a fifth pair of registration marks to be periodically printed in said fifth color on said web; and a sixth rotatable printing roller that prints ink of a sixth color on said web of material, said sixth printing roller causing a sixth pair of registration marks to be periodically printed in said sixth color on said web, and wherein said controller is programmed to identify said pairs of registration marks based on image data representing said registration marks and based on registration mark reference data for at least six registration mark pairs defined by said registration mark relationship table.

3. A printing press as recited in claim 1 wherein said controller is programmed to identify one of said pairs of registration marks by comparing x, y offset data associated with said one pair of registration marks with said registration mark reference data.

4. A controller for a printing press, comprising:

a processor;

a memory operatively coupled to said processor; and a computer program stored in said memory and executed by said processor, said computer program causing said processor to identify a pair of printed registration marks based on image data generated from detection of said printed registration marks and based on registration mark reference data for at least three registration mark pairs defined by a registration mark relationship table set forth below:

| Pair | Offset X | Offset Y |
|---|---|---|
| Color A | 0 | 8 |
| Color B | 8 | 0 |
| Color C | 12 | −6 |
| Color D | 12 | 6 |
| Color E | 6 | −12 |
| Color F | 6 | 12 |
| Color G | 20 | −4 |
| Color H | 20 | 4 |
| Color I | 4 | −20 |
| Color J | 4 | 20 |

wherein said Offset X value for each of said registration mark pairs corresponds to an offset value in a first direction between said registration marks in said registration mark pair, and wherein said Offset Y value for each of said registration mark pairs corresponds to an offset value in a second direction between said registration marks in said registration mark pair, said second direction being perpendicular to said first direction.

5. A controller as recited in claim 4 wherein said processor identifies said pair of registration marks based on registration mark reference data for at least five registration mark pairs defined by said registration mark relationship table.

6. A controller as recited in claim 4 wherein said processor identifies said pair of registration marks based on registration mark reference data for ten registration mark pairs defined by said registration mark relationship table.

7. A method, comprising:

printing a first pair of registration marks in a first color on a web of material with a first rotatable printing roller;

printing a second pair of registration marks in a second color on said web of material with a second rotatable printing roller;

printing a third pair of registration marks in a third color on said web of material with a third rotatable printing roller;

generating image data representing said registration marks printed on said web by said printing rollers;

identifying said pairs of registration marks based on said image data and based on registration mark reference data for at least three registration mark pairs defined by a registration mark relationship table set forth below:

| Pair | Offset X | Offset V |
|---|---|---|
| Color A | 0 | 8 |
| Color B | 8 | 0 |
| Color C | 12 | −6 |
| Color D | 12 | 6 |
| Color E | 6 | −12 |
| Color F | 6 | 12 |
| Color G | 20 | −4 |
| Color H | 20 | 4 |
| Color I | 4 | −20 |
| Color J | 4 | 20 |

wherein said Offset X value for each of said registration mark pairs corresponds to an offset value in a first direction between said registration marks in said registration mark pair, and wherein said Offset Y value for each of said registration mark pairs corresponds to an offset value in a second direction between said registration marks in said registration mark pair, said second direction being perpendicular to said first direction.

8. A method as recited in claim 7 comprising:

printing a fourth pair of registration marks in a fourth color on a web of material with a fourth rotatable printing roller;

printing a fifth pair of registration marks in a fifth color on said web of material with a fifth rotatable printing roller;

printing a sixth pair of registration marks in a sixth color on said web of material with a sixth rotatable printing roller; and identifying said pairs of registration marks based on image data representing said registration marks and based on registration mark reference data for at least six registration mark pairs defined by said registration mark relationship table.

9. A method as recited in claim 7 comprising identifying one of said pairs of registration marks by comparing x, y offset data associated with said one pair of registration marks with said registration mark reference data.

10. A printing press, comprising:

a first rotatable printing roller that prints ink of a first color on a web of material, said first printing roller causing a first pair of registration marks to be periodically printed in said first color on said web;

a second rotatable printing roller that prints ink of a second color on said web of material, said second printing roller causing a second pair of registration marks to be periodically printed in said second color on said web;

a third rotatable printing roller that prints ink of a third color on said web of material, said third printing roller causing a third pair of registration marks to be periodically printed in said third color on said web;

an imaging device positioned to detect said registration marks printed on said web by said printing rollers, said imaging device generating image data representing said registration marks; and a controller operatively coupled to said printing rollers and said imaging device, said controller comprising a processor and a memory, said controller being programmed to group said registration marks in pairs based on said image data by generating a list of possible registration mark pairs and by eliminating from said list at least one of said possible registration mark pairs.

11. A printing press as recited in claim 10 wherein said controller is programmed to determine a centerpoint for each of said pairs of registration marks and wherein said controller generates a registration correction value for one of said printing rollers based on a plurality of said centerpoints.

12. A method, comprising:

printing a first pair of registration marks in a first color on a web of material with a first rotatable printing roller;

printing a second pair of registration marks in a second color on said web of material with a second rotatable printing roller;

printing a third pair of registration marks in a third color on said web of material with a third rotatable printing roller;

generating image data representing said registration marks printed on said web by said printing rollers; and grouping said registration marks in pairs based on said image data by generating a list of possible registration mark pairs and by eliminating from said list at least one of said possible registration mark pairs.

13. A method as recited in claim 12 comprising:

determining a centerpoint for each of said pairs of registration marks; and generating a registration correction value for one of said printing rollers based on a plurality of said centerpoints.

14. A method as recited in claim 12 comprising determining an offset value between a first registration mark in one of said pairs of registration marks and a second registration mark in said one pair of registration marks, said offset value being determined based upon a dimension of one of said registration marks.

15. A method as recited in claim 12 comprising determining an offset value based on a spacing between said first registration mark and said second registration mark and based on said dimension of one of said first and second registration marks.

16. A method as recited in claim 12 comprising:

generating a registration correction value for one of said printing rollers based on said image data; and transmitting said registration correction value to a phase correction mechanism operatively coupled to one of said printing rollers to adjust the phase of said one printing roller.

17. A printing press, comprising:

a first rotatable printing roller that prints ink of a first color on a web of material, said first printing roller causing a first pair of registration marks to be periodically printed in said first color on said web;

a second rotatable printing roller that prints ink of a second color on said web of material, said second printing roller causing a second pair of registration marks to be periodically printed in said second color on said web;

a third rotatable printing roller that prints ink of a third color on said web of material, said third printing roller causing a third pair of registration marks to be periodically printed in said third color on said web;

an imaging device positioned to detect said registration marks printed on said web by said printing rollers, said imaging device generating image data representing said registration marks; and a controller operatively coupled to said printing rollers and said imaging device, said controller comprising a processor and a memory, said controller being programmed to determine an offset value between a first registration mark in one of said pairs of registration marks and a second registration mark in said one pair of registration marks, said offset value being determined based upon a dimension of one of said registration marks.

18. A printing press as recited in claim 17 wherein each of said first and second registration marks comprises a four-sided registration mark and wherein said dimension comprises a height of one of said first and second registration marks.

19. A printing press as recited in claim 17 wherein said controller is programmed to determine said offset value based on a spacing between said first registration mark and said second registration mark and based on said dimension of one of said first and second registration marks.

20. A printing press as recited in claim 17 wherein said controller is programmed to group said registration marks in pairs based upon said image data, wherein said controller is programmed to determine a centerpoint for each of said pairs of registration marks, and wherein said controller generates a registration correction value for one of said printing rollers based on a plurality of said centerpoints.

21. A printing press as recited in claim 20 additionally comprising a phase correction mechanism operatively coupled to said one printing roller, wherein said controller is operatively coupled to said one printing roller via said phase correction mechanism, and wherein said phase of said one printing roller is adjusted based on said registration correction value.

22. A method, comprising:

printing a first pair of registration marks in a first color on a web of material with a first rotatable printing roller;

printing a second pair of registration marks in a second color on said web of material with a second rotatable printing roller;

printing a third pair of registration marks in a third color on said web of material with a third rotatable printing roller;

generating image data representing said registration marks printed on said web by said printing rollers; and determining an offset value between a first registration mark in one of said pairs of registration marks and a second registration mark in said one pair of registration marks, said offset value being determined based upon a dimension of one of said registration marks.

23. A method as recited in claim 22 comprising determining said offset value based upon a height of one of said first and second registration marks.

24. A method as recited in claim 22 comprising:

determining a centerpoint for each of said pairs of registration marks; and generating a registration correction value for one of said printing rollers based on a plurality of said centerpoints.

25. A method as recited in claim 22 comprising:

generating a registration correction value for one of said printing rollers based on said image data; and transmitting said registration correction value to a phase correction mechanism operatively coupled to one of said printing rollers to adjust the phase of said one printing roller.

26. A printing press, comprising:

a first rotatable printing roller that prints ink of a first color on a web of material, said first printing roller causing a first registration mark to be periodically printed in said first color on said web;

a second rotatable printing roller that prints ink of a second color on said web of material, said second printing roller causing a second registration mark to be periodically printed in said second color on said web;

a third rotatable printing roller that prints ink of a third color on said web of material, said third printing roller causing a third registration mark to be periodically printed in said third color on said web;

an imaging device positioned to detect said registration marks printed on said web by said printing rollers, said imaging device generating image data representing said registration marks; and a controller operatively coupled to said printing rollers and said imaging device, said controller comprising a processor and a memory, said controller being programmed to generate a registration correction value for one of said printing rollers based on data indicative of a spacing between a plurality of said registration marks and based on a dimension of at least one of said registration marks.

27. A printing press as recited in claim 26 wherein each of said registration marks comprises a four-sided registration mark and wherein said dimension comprises a height of one of said registration marks.

28. A printing press as recited in claim 26 additionally comprising a phase correction mechanism operatively coupled to said one printing roller, wherein said controller is operatively coupled to said one printing roller via said phase correction mechanism, and wherein said phase of said one printing roller is adjusted based on said registration correction value.

29. A method, comprising:

printing a first registration mark in a first color on a web of material with a first rotatable printing roller;

printing a second registration mark in a second color on said web of material with a second rotatable printing roller;

printing a third registration mark in a third color on said web of material with a third rotatable printing roller;

generating image data representing said registration marks printed on said web by said printing rollers; and generating a registration correction value for one of said printing rollers based on data indicative of a spacing between a plurality of said registration marks and based on a dimension of at least one of said registration marks so that said registration correction value may be generated regardless of the size of said registration marks.

30. A method as recited in claim 29 comprising transmitting said registration correction value to a phase correction mechanism operatively coupled to one of said printing rollers to adjust the phase of said one printing roller.

* * * * *